United States Patent [19]

McBride

[11] Patent Number: 4,938,370

[45] Date of Patent: Jul. 3, 1990

[54] TAMPER-INDICATING PLASTIC CLOSURE

[75] Inventor: Stephen W. McBride, Brownsburg, Ind.

[73] Assignee: H-C Industries, Inc., Crawfordsville, Ind.

[21] Appl. No.: 343,995

[22] Filed: Apr. 26, 1989

[51] Int. Cl.[5] ..... B65D 41/34

[52] U.S. Cl. ..... 215/252

[58] Field of Search ..... 215/252

[56] References Cited

U.S. PATENT DOCUMENTS

| | | | |
|---|---|---|---|
| 4,196,818 | 4/1980 | Brownbill | 215/252 |
| 4,343,754 | 8/1982 | Wilde et al. | 264/154 |
| 4,378,893 | 4/1983 | Wilde et al. | 215/246 |
| 4,394,918 | 7/1983 | Grussen | 215/252 X |
| 4,401,227 | 8/1983 | Pehr | 215/252 |
| 4,402,418 | 9/1983 | Ostrowsky | 215/252 |
| 4,418,828 | 12/1983 | Wilde et al. | 215/252 |
| 4,469,234 | 9/1984 | Duessen | 215/252 |
| 4,497,765 | 2/1985 | Wilde et al. | 215/252 X |
| 4,506,795 | 3/1985 | Herr | 215/252 |
| 4,511,054 | 4/1985 | Shank | 215/252 |
| 4,550,843 | 11/1985 | Nolan | 215/252 |
| 4,550,844 | 11/1985 | Lininger | 215/252 |
| 4,572,388 | 2/1986 | Luker et al. | 215/252 |
| 4,613,052 | 9/1986 | Gregory et al. | 215/252 |
| 4,635,808 | 1/1987 | Nolan | 215/252 |
| 4,664,279 | 5/1987 | Obrist et al. | 215/252 |
| 4,674,643 | 6/1987 | Wilde et al. | 215/252 |
| 4,751,036 | 6/1988 | Barriac | 215/252 X |
| 4,784,280 | 11/1988 | Breuer et al. | 215/252 |
| 4,801,030 | 1/1989 | Barriac | 215/252 |
| 4,807,771 | 2/1989 | Roy et al. | 215/252 |

FOREIGN PATENT DOCUMENTS 56-74445 6/1981 Japan .

*Primary Examiner*—Donald F. Norton

*Attorney, Agent, or Firm*—Dressler, Goldsmith, Shore, Sutker & Milnamow, Ltd.

[57] ABSTRACT

A tamper-indicating plastic closure is disclosed, with the closure configured for interfering coaction with an associated container. The closure includes a plastic cap having a top wall portion and an internally threaded annular skirt portion, with an annular pilfer band depending therefrom. The pilfer band includes a plurality of circumferentially spaced flexible tabs configured for interfering engagement with an annular locking ring portion of the associated container. The pilfer band further includes an annular interference bead positioned beneath the flexible tabs. By this arrangement, two modes of interfering engagement with the associated container locking ring are provided.

17 Claims, 2 Drawing Sheets

TAMPER-INDICATING PLASTIC CLOSURE

TECHNICAL FIELD

The present invention relates generally to tamper-indicating or tamper-evident packaging arrangements, and more particularly to a tamper-indicating plastic closure for a container which functions to provide two modes of interference with the container for enhanced tamper resistance.

BACKGROUND OF THE INVENTION

The provision of tamper-indicating or tamper-evident closures for containers is desirable for all manner of consumer products, so that partial or complete removal of the closure results in clearly discernable visible alteration thereof. Typically, closures of this nature include an upper cap portion, and a depending pilfer band arranged to interact and cooperate with the container to which the closure is applied. The pilfer band is typically configured so as to fracture and/or separate from the closure cap attendant to closure removal, thereby providing clearly discernable evidence that the container has been partially or completely opened.

As will be appreciated, it is desirable for a tamper-indicating closure to be as resistant as possible to tampering or the like without visibly discernable evidence thereof. To this end, the present plastic closure has been particularly configured for economical and efficient manufacture for use on existing containers, with the closure being highly resistant to tampering, consistent and reliable in performance, and highly versatile for use with a wide variety of different containers.

SUMMARY OF THE INVENTION

The present invention relates to a tamper-indicating plastic closure for a container having a typical annular locking ring positioned adjacent to and beneath the threads on the neck portion of the container. For tamper-indication, the closure includes a pilfer band having a plurality of inwardly extending flexible tabs, with the pilfer band further including a coacting interference bead positioned beneath the flexible tabs. Notably, the pilfer band functions to provide dual modes of interfering interaction with the container locking ring for tamper-indication.

In accordance with the invention, the present plastic closure includes a plastic cap having a circular top wall portion, and an annular depending cylindrical skirt portion. In the illustrated embodiment, the skirt portion includes an internal thread formation adapted for coaction with a mating thread formation on the neck portion of the associated container for retaining the closure thereon after application to the container.

The present closure further includes an annular, integrally formed pilfer band depending from the skirt portion of the closure cap. The pilfer band is at least partially detachably connected to the skirt portion of the cap by a plurality of circumferentially spaced frangible ribs. In the illustrated embodiment, the frangible ribs extend between inside surfaces of the skirt portion and pilfer band, with the skirt portion and pilfer band otherwise being distinguished and separated from each other by a circumferential score line which extends partially into the frangible ribs.

The pilfer band includes an annular band portion, and a plurality of circumferentially spaced, inwardly extending flexible tabs which extend inwardly of the annular band portion. Notably, the pilfer band further includes an annular interference bead extending generally inwardly of the annular band portion, with the interference bead positioned beneath the inwardly extending flexible tabs.

By this arrangement, two modes of interfering interaction, for tamper-indication, are provided between the flexible tabs and the annular locking ring of the container. During application of the closure to the container, the flexible tabs are bent upwardly to an out-of-the-way disposition as the pilfer band moves downwardly past the container threads and locking ring. As the closure is fully seated on the container, the flexible tabs move past the container locking ring, and due to their resilient memory, move inwardly to assume an angularly generally upwardly and inwardly disposition relative to the annular band portion. In this disposition of the flexible tabs, they are positioned for interfering engagement with the generally downwardly facing surface of the container locking ring, whereby in this first mode of interference, the free end portions of the flexible tabs engage the locking ring for fracturing the frangible ribs which at least partially detachably connect the pilfer band to the skirt portion of the closure cap. Clearly visible evidence of opening is thus provided.

In a second mode of interfering interaction, the flexible tabs cooperate and coact with the interference bead of the pilfer band to again interferingly engage and coact with the container locking ring. In this mode of operation, the flexible tabs are engageable with the container locking ring in the event that the flexible tabs assume an angularly downwardly and inwardly extending disposition relative to the annular band portion of the pilfer band. In this orientation, the flexible tabs are engageable with the container locking ring by disposition between the locking ring and the annular interference bead. The flexible tabs and interference bead are dimensioned relative to the container locking ring so as to resist opening movement of the closure, thereby fracturing the frangible ribs joining the pilfer band to the skirt portion. Again, clear visual evidence of opening is achieved.

Numerous other features and advantages of the present invention will become readily apparent from the following detailed description, the accompanying drawings, and the appended claims.

DETAILED DESCRIPTION

Figure 1:
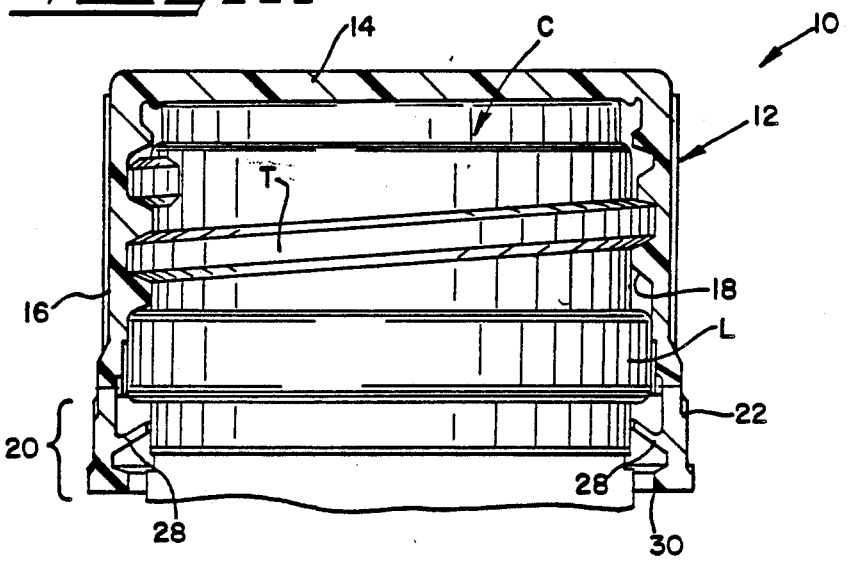
FIG. 1 is a side elevational view, in partial cross-section, of a tamper-indicating plastic closure embodying the principles of the present invention applied to an associated container.
Figure 2:
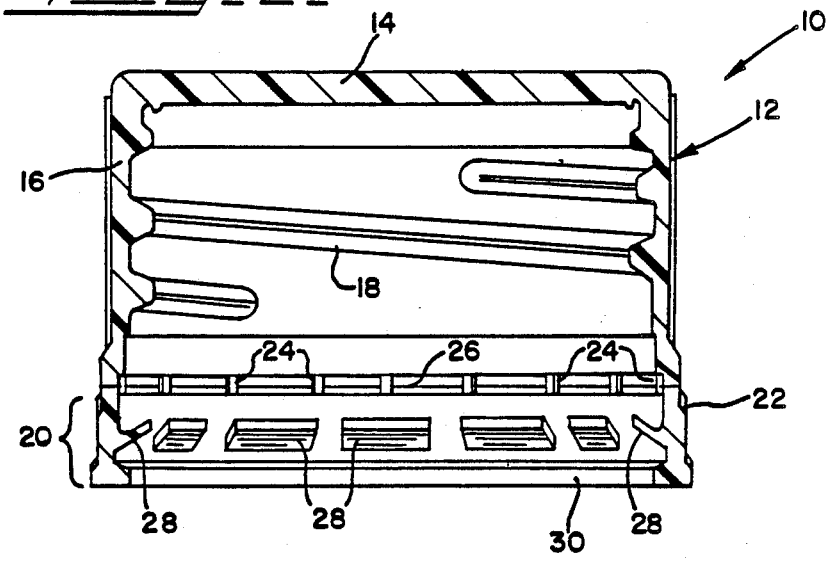
FIG. 2 is a cross-sectional view of the novel tamper-indicating closure.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

With reference first to FIG. 1, therein is illustrated a plastic closure 10 embodying the principles of the present invention. Closure 10 can be made by various injection-molding or compression-molding techniques, and it can be formed in accordance with the compression-molding techniques taught in U.S. Pat. No. 4,497,765, which is incorporated herein by reference.

As illustrated, closure 10 includes an upper generally cup-shaped closure cap 12 including a circular top wall portion 14, and a depending, annular cylindrical skirt portion 16. Skirt portion 16 preferably includes an internal thread formation 18 configured for threading engagement in cooperation with the threads T of an associated container C to which the closure is fitted. If desired, the plastic closure can be provided with an associated sealing liner, such as illustrated in the above-referenced patent.

The present closure further includes an annular pilfer band 20 depending from and at least partially detachably connected to skirt portion 16 of the closure cap. Pilfer band 20 preferably comprises a continuous annular band portion 22 arranged in substantial vertical alignment with skirt portion 16. In the preferred embodiment, the pilfer band is at least partially detachably connected to the skirt portion by a plurality of circumferentially spaced frangible ribs 24 which extend between the inside surfaces of the skirt portion 16 and the band portion 22 of the pilfer band. As shown, the pilfer band 20 is otherwise distinguished and separated from the skirt portion 16 by a circumferentially extending score line 26.

In accordance with the teachings of U.S. Pat. No. 4,418,828, incorporated herein by reference, score line 26 and frangible rib 24 together cooperate to provide the desired frangible connection between the pilfer band 20 and the closure cap 12. Specifically, the closure cap 12 and the pilfer band 20 are formed integrally with each other during molding, with the ribs 24 molded on the inside surfaces of the skirt portion and pilfer band. Thereafter, score line 26 is formed, preferably by use of a scoring cutting blade, thereby distinguishing and separating the pilfer band 20 from the skirt portion 16, with the score line 26 extending partially into the ribs 24.

By this arrangement, the unscored, "residual" portions of the frangible ribs 24 collectively provide the desired frangible connection between the pilfer band and the skirt portion. If desired, an integral connector portion can be provided between the pilfer band and the skirt portion (such as by leaving a portion of the closure uncut by score line 26) whereby the pilfer band remains connected to the skirt portion 16 after fracture of the ribs. In conjunction with such a connector portion, one or more fracturable areas can be provided in the pilfer band itself, whereby the pilfer band splits and fractures during closure removal from the associated container.

Referring now to the configuration of the pilfer band 20, the present closure has been specifically configured to provide a very high degree of tamper resistance, and in particular provides two distinct and separate modes of interfering interaction with the associated container. To this end, the pilfer band includes a plurality of circumferentially spaced, inwardly extending flexible tabs 28 which extend inwardly from the annular band portion 22 of the pilfer band. In a current embodiment, twelve evenly spaced tabs 28 are provided about the circumference of the pilfer band, with each tab having a width of about 0.240 inches, and a thickness of between about 0.012 inches and 0.020 inches. By this arrangement, the free end portions of adjacent ones of the tabs 28 are closely spaced (about 0.020 inch spacing) when the tabs extend horizontally inwardly. This horizontally inwardly extending orientation of the tabs is indicated in phantom line, and represents the orientation in which the flexible tabs 28 are preferably molded.

As will be further described, the flexible tabs 28 cooperate with an annular locking ring portion L of container C for effecting fracture of frangible ribs 24, thereby providing the desired tamper-indication. In a first mode of interference and failure, the free end portions of the flexible tabs are engageable with the locking ring L. In a second mode of failure, the flexible tabs are configured to cooperate with an annular interference bead 30 provided generally at the lower edge of annular band portion 22 of the pilfer band 20. To this end, the interference bead 30 is positioned beneath the flexible tabs 28, with the upper, inward edge portion of the interference bead positioned relative to the flexible tabs so that this edge portion is engaged by the tabs in the second failure mode. In the preferred form, the inside diameter of the interference bead is about equal to or slightly less than an inside diameter collectively defined by the inside surfaces of the circumferentially spaced frangible ribs 24.

Figure 3:
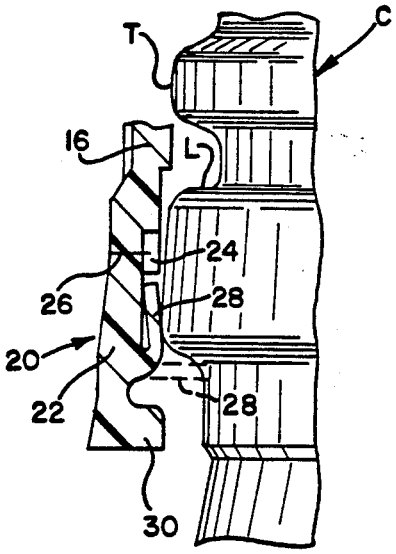
FIG. 3 is a fragmentary, side-elevational view, in partial cross-section illustrating application of the novel closure to the associated container.

Referring now to FIG. 3, the function of the present closure will be described. During application of the closure 10 to the associated container, the flexible tabs 28 engage the container C and are moved upwardly generally to an upwardly extending, out-of-the-way disposition as the pilfer band moves downwardly relative to the container threads T and the container locking ring L. To this end, the flexible tabs 28 are preferably provided with a thickness about equal to the radial dimension of the frangible ribs 24, or the tabs 28 are otherwise configured to collectively define an inside diameter about equal to an inside diameter collectively defined by the ribs 24.

Figure 4:
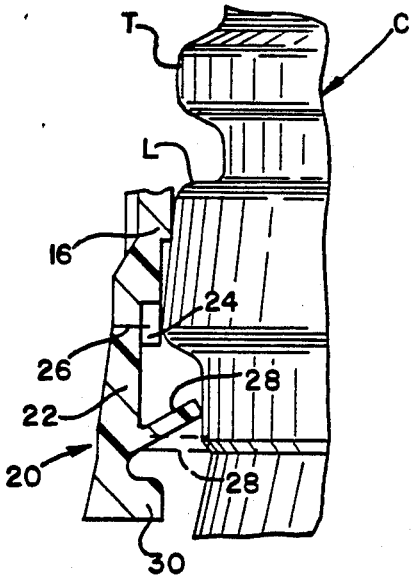
FIG. 4 is a view similar to FIG. 3 illustrating the closure after application to the associated container, and in a position for providing a first mode of interfering engagement with the container.

When the closure is fully seated on the container, the flexible tabs 28 have moved past the container locking ring L, and thereafter, due to the resilient memory of the plastic, assume a generally angularly upwardly and inwardly extending disposition, as illustrated in FIG. 4. The flexible tabs 28 are now in position for the first mode of interfering interaction and failure in cooperation with the container locking ring. Specifically, unscrewing upward movement of the closure 10 relative to the container urges the generally upwardly extending flexible tabs 28 into and against the container locking ring L. This interfering engagement with the container locking ring acts to resist the upward unscrewing movement of the closure, thereby stressing and fracturing the frangible ribs 24. Fracture of the ribs 24 results in clearly visibly discernable separation of the pilfer band 20 from the skirt portion 16, thus providing a clear indication of opening of the container.

In a current embodiment, each flexible tab 28 is of a generally planar configuration, having a thickness dimensioned between about 0.012 inches and 0.020 inches. However, as will be appreciated, each flexible tab 28 is preferably dimensioned and configured for sufficient thickness, in the direction from its free end to its base integral with the band portion 22, so as to exhibit sufficient resistance to collapse or deformation to thereby provide the desired interfering interaction with locking band L. To this end, each of the tabs 28 may be of a non-planar configuration, such as being slightly curved when viewed in cross-section perpendicular to the length of each tab, or similarly, of a generally angled or compound configuration when similarly viewed. As will be appreciated, such arrangements can act to enhance the "column strength" of each flexible tab for providing the desired interfering engagement with locking ring L.

Figure 5:
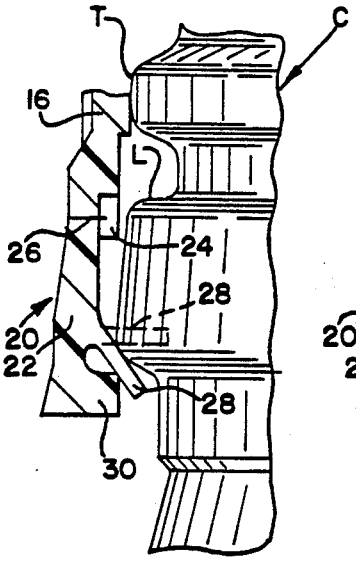
FIG. 5 is a view similar to FIG. 4, illustrating the closure in position for effecting a second mode of interfering engagement with the associated container.
Figure 6A:
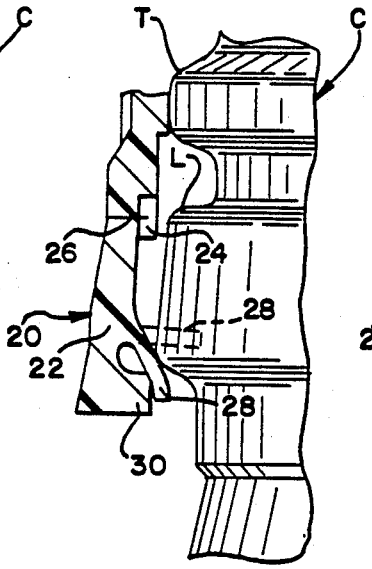
FIGS. 6a and 6b are views similar to FIG. 5, further illustrating the second mode of interfering engagement of the closure with the associated container.
Figure 6B:
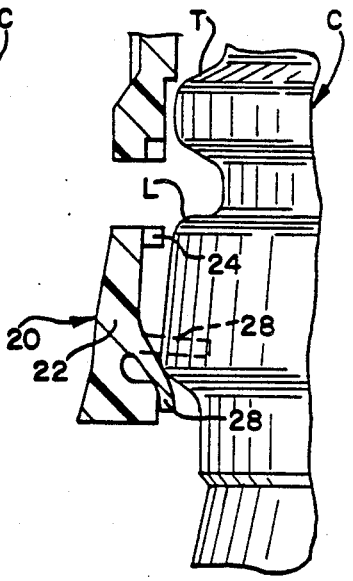

In accordance with the present invention, the flexible tabs 28 are configured for cooperation with interference bead 30 to provide a second and distinct mode of interfering engagement with the container locking ring L. In the event that the flexible tabs 28 are moved from their angularly upwardly and inwardly disposition (such as by unauthorized manipulation or the like, which is desirably inhibited by the inwardly extending bead 30) the flexible tabs will assume an angularly downwardly and inwardly extending disposition, as illustrated in FIG. 5. In this orientation of the tabs, the tabs are positioned for engagement with the container locking ring L by disposition between the container locking ring and the upper inward edge of the interference bead 30. In this manner, the tabs cooperate and coact with the interference bead to again provide interfering interaction with the container locking ring, to thereby fracture frangible ribs 24 for at least partially detaching the pilfer band 20 from the skirt portion 16. This action is illustrated in FIGS. 6*a* and 6*b*, where in FIG. 6*a*, a flexible tab 28 is illustrated between the locking ring L and the interference bead 30, with FIG. 6*b* illustrating the subsequent failure of frangible rib 24 and separation along score line 26.

Thus, a high degree of tamper-resistance is provided by the present closure. As will be appreciated, various modifications and departures from the illustrated embodiment can be effected. For example, the number, spacing, thickness, and configuration of the flexible tabs 28 can be varied and selected while keeping with the principles disclosed herein. Similarly, while the annular interference bead 30 is preferably substantially continuous in nature for providing additional circumferential hoop strength for the closure, segmented or otherwise discontinuous configurations for the interference bead can be alternately employed. Moreover, while the present invention has been illustrated in the form of a one-piece, all plastic closure, it will be appreciated that a closure embodying the present invention may be composite in nature, such as a combination metallic and plastic closure (with or without a separate sealing liner).

From the foregoing, it will be observed that numerous modifications and variations can be effected without departing from the true spirit and scope of the novel concept of the present invention. It is to be understood that no limitation with respect to the specific embodiment is intended or should be inferred. The disclosure is intended to cover by the appended claims all such modifications as fall within the score of the claims.

What is claimed is:

1. A tamper-indicating plastic closure for a container having an annular locking ring, said closure comprising:
   a plastic cap including a top wall portion, and an annular, depending cylindrical skirt portion, and
   an annular pilfer band at least partially detachably connected to and depending from said skirt portion,
   said pilfer band including inwardly extending flexible tab means comprising a plurality of circumferentially spaced, flexible tabs extending inwardly of said pilfer band and each having a free end portion, and inwardly extending interference bead means positioned beneath said tab means, said free end portions of said flexible tabs of said tab means being engageable with said container locking ring when said flexible tabs extend upwardly and inwardly during removal of said closure from said container for providing a first means for at least partially detaching said pilfer band from said skirt portion,
   said tab means being further engageable with said locking ring during removal of said closure from said container by disposition of said tab means between said locking ring and said interference bead means for providing a second means for at least partially detaching said pilfer band from said skirt portion.

2. A tamper-indicating plastic closure in accordance with claim 1, including
   frangible rib means for at least partially detachably connecting said pilfer band to said skirt portion.

3. A tamper-indicating plastic closure in accordance with claim 2, wherein
   said frangible means comprise a plurality of circumferentially spaced frangible ribs extending between inside surfaces of said skirt portion and said pilfer band, said pilfer band being distinguished and at least partially separated from said skirt portion by circumferential score means extending partially into said frangible ribs.

4. A tamper-indicating plastic closure in accordance with claim 1, wherein
   said tab means comprises a plurality of circumferentially spaced, flexible tabs extending inwardly of said pilfer band, and said interference bead means comprises an annular interference bead positioned beneath said flexible tabs.

5. A tamper-indicating plastic closure for a container having an annular locking ring, said closure comprising:
   a plastic cap having a top wall portion, and an annular, depending cylindrical skirt portion having an internal thread formation, and
   an annular pilfer band depending from said skirt portion and at least partially detachably connected thereto by frangible rib means,
   said pilfer band including an annular band portion, a plurality of circumferentially spaced, inwardly extending flexible tab means, and an annular interference bead positioned beneath said flexible tab means and extending inwardly of the bottom edge of said annular band portion,
   said flexible tab means being engageable with said container locking ring: (1) when said flexible tab means extend generally angularly upwardly and inwardly of said annular band portion for fracturing said frangible rib means, and (2) when said flexible tab means extend generally angularly downwardly and inwardly of said annular band and are disposed between said annular locking ring and said interference bead for fracturing said frangible rib means.

6. A tamper-indicating plastic closure in accordance with claim 5, wherein said frangible rib means comprises a plurality of frangible ribs extending between the inside surfaces of said skirt portion and said annular band portion of said pilfer band.

7. A tamper-indicating plastic closure in accordance with claim 6, wherein said frangible ribs collectively define a first inside diameter of said pilfer band, said annular interference bead defining a second inside diameter about equal to or less than said first inside diameter.

8. A tamper-indicating plastic closure in accordance with claim 6, wherein each of said flexible tab means has a thickness about equal to the radial dimension of said frangible ribs.

9. A tamper-indicating plastic closure in accordance with claim 6, wherein each of said flexible tab means is a generally planar configuration.

10. A tamper-indicating plastic closure in accordance with claim 9, wherein each of said flexible tab means has a thickness dimension between about 0.012 inches and 0.020 inches.

11. A tamper-indicating closure for a container having an annular locking ring, said closure comprising:

a cap including a top wall portion, and an annular, depending cylindrical skirt portion, an annular pilfer band at least partially detachably connected to and depending from said skirt portion, and a plurality of circumferentially spaced frangible ribs extending between inside surfaces of said skirt portion and said pilfer band for at least partially detachably connecting said pilfer band to said skirt portion, said frangible ribs collectively defining a first inside diameter of said pilfer band, said pilfer band including inwardly extending flexible tab means, and inwardly extending, annular interference bead means positioned beneath said tab means, said tab means being engageable with said container locking ring and said annular interference bead means during removal of said closure from said container for at least partially detaching said pilfer band from said skirt portion, said interference bead means inhibiting manipulation of said flexible tab means, said interference bead means defining a second inside diameter about equal to or less than said first inside diameter.

12. A tamper-indicating plastic closure in accordance with claim 11, wherein said tab means comprises a plurality of circumferentially spaced, flexible tabs extending inwardly of said pilfer band.

13. A tamper-indicating plastic closure for a container having an annular locking ring, said closure comprising:

a plastic cap including a top wall portion, and an annular, depending cylindrical skirt portion, an annular pilfer band at least partially detachably connected to and depending from said skirt portion, and frangible rib means for at least partially detachably connecting said pilfer band to said skirt portion, said frangible rib means comprising a plurality of circumferentially spaced frangible ribs extending between inside surfaces of said skirt portion and said pilfer band, said pilfer band being distinguished and at least partially separated from said skirt portion by circumferential score means extending partially into said frangible ribs, said pilfer band including inwardly extending flexible tab means, and inwardly extending interference bead means positioned beneath said tab means, said tab means comprising a plurality of circumferentially spaced, flexible tabs extending inwardly of said pilfer band, said flexible tabs being movable during application of said closure to said container to an upwardly extending disposition as the pilfer band moves downwardly relative to said locking ring so that said tabs collectively define an inside diameter of said closure about equal to another inside diameter of said closure collectively defined by said frangible ribs, said tab means being engageable with said container locking ring during removal of said closure from said container by disposition of said tab means between said locking ring and said interference bead means for at least partially detaching said pilfer band from said skirt portion by fracture of said frangible ribs.

14. A tamper-indicating plastic closure for a container having an annular locking ring, said closure comprising:

a plastic cap having a top wall portion, and an annular, depending cylindrical skirt portion having an internal thread formation, and an annular pilfer band, including an annular band portion, depending from said skirt portion and at least partially detachably connected thereto by frangible rib means, said frangible rib means comprising a plurality of frangible ribs extending between the inside surfaces of said skirt portion and said annular band portion of said pilfer band, said pilfer band including a plurality of circumferentially spaced, inwardly extending flexible tab means, and an annular interference bead positioned beneath said flexible tab means and extending inwardly of the bottom edge of said annular band portion, each of said flexible tab means having a thickness about equal to the radial dimension of said frangible ribs, said flexible tab means being engageable with said container locking ring and with said interference bead by disposition therebetween during removal of said closure from said container for fracturing said frangible rib means.

15. A tamper-indicating plastic closure in accordance with claim 14, wherein said frangible rib means collectively define a first inside diameter of said pilfer band, said annular interference bead defining a second inside diameter about equal to or less than said first inside diameter.

16. A tamper-indicating plastic closure in accordance with claim 14, wherein each of said flexible tab means is a generally planar configuration.

17. A tamper-indicating plastic closure in accordance with claim 14, wherein each of said flexible tab means has a thickness dimension between about 0.012 inches and 0.020 inches.

* * * * *

US004938370B1

REEXAMINATION CERTIFICATE (4171st)

United States Patent [19] [11] B1 4,938,370

McBride [45] Certificate Issued Oct. 17, 2000

[54] TAMPER-INDICATING PLASTIC CLOSURE

[75] Inventor: Stephen W. McBride, Brownsburg, Ind.

[73] Assignee: H-C Industries, Inc., Crawfordsville, Ind.

Reexamination Request:
No. 90/005,145, Oct. 9, 1998

Reexamination Certificate for:

| | |
|---|---|
| Patent No.: | **4,938,370** |
| Issued: | **Jul. 3, 1990** |
| Appl. No.: | **07/343,995** |
| Filed: | **Apr. 26, 1989** |

[51] Int. Cl.[7] ..... B65D 41/34
[52] U.S. Cl. ..... 215/252
[58] Field of Search ..... 215/252

[56] References Cited

U.S. PATENT DOCUMENTS

| | | | |
|---|---|---|---|
| 4,497,765 | 2/1985 | Wilde et al. | 215/252 X |
| 4,550,843 | 11/1985 | Nolan | 215/252 |
| 4,635,808 | 1/1987 | Nolan | 215/252 |
| 4,674,643 | 6/1987 | Wilde et al. | 215/252 |
| 4,848,614 | 7/1989 | Csaszar | 215/252 |

*Primary Examiner*—Stephen K. Cronin

[57] ABSTRACT

A tamper-indicating plastic closure is disclosed, with the closure configured for interfering coaction with an associated container. The closure includes a plastic cap having a top wall portion and an internally threaded annular skirt portion, with an annular pilfer band depending therefrom. The pilfer band includes a plurality of circumferentially spaced flexible tabs configured for interfering engagement with an annular locking ring portion of the associated container. The pilfer band further includes as annular interference bead positioned beneath the flexible tabs. By this arrangement, two modes of interfering engagement with the associated container locking ring are provided.

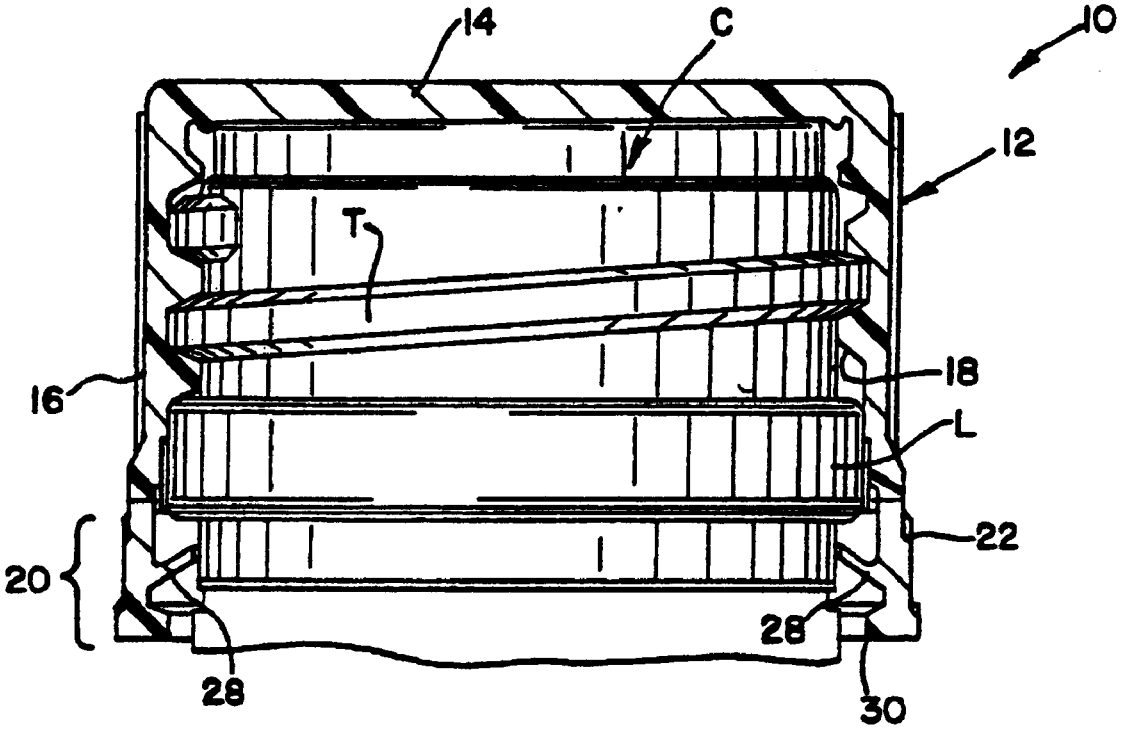

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–10 and 13 is confirmed.

Claims 11 and 14 are determined to be patentable as amended.

Claims 12 and 15–17, dependent on an amended claim, are determined to be patentable.

11. A tamper-indicating closure for a container having an annular locking ring, said closure comprising:

a cap including a top wall portion, and an annular, depending cylindrical skirt portion, an annular pilfer band at least partially detachably connected to and depending from said skirt portion, and a plurality of circumferentially spaced frangible ribs extending between inside surfaces of said skirt portion and said pilfer band for at least partially detachably connecting said pilfer band to said skirt portion, said frangible ribs collectively defining a first inside diameter of said pilfer band, said pilfer band including *an annular band portion,* inwardly extending flexible tap means *extending inwardly therefrom*, and inwardly extending annular interference bead means positioned beneath said tab means, said tab means being engageable with said container locking ring and said annular interference bead means during removal of said closure from said container for at least partially detaching said pilfer band from said skirt portion, said interference bead means inhibiting manipulation of said flexible tab means, said interference bead means defining a second inside diameter about equal to or less than said first inside diameter, *said flexible tab means being engageable with said container locking ring: (1) when said flexible tab means extend generally angularly upwardly and inwardly of said annular band portion for fracturing said frangible ribs, and (2) when said flexible tab means extend generally angularly downwardly and inwardly of said annular band portion and are disposed between said annular locking ring and said interference bead means for fracturing said frangible ribs.*

14. A tamper-indicating plastic closure for a container having an annular locking ring, said closure comprising:

a plastic cap having a top wall portion, and an annular, depending cylindrical skirt portion having an internal thread formation, and an annular pilfer band, including an annular band portion, depending from said skirt portion and at least partially detachably connected thereto by frangible rib means, said frangible rib means comprising a plurality of frangible ribs extending between the inside surfaces of said skirt portion and said annular band portion of said pilfer band, said pilfer band including a plurality of circumferentially spaced, inwardly extending flexible tab means, and an annular interference bead positioned beneath said flexible tab means and extending inwardly of the bottom edge of said annular band portion, each of said flexible tab means having a thickness about equal to the radial dimension of said frangible ribs, said flexible tab means being engageable with said container locking ring *when said flexible tab means extend generally angularly upwardly and inwardly of said annular band portion for fracturing said frangible rib means, and being engageable with said container locking ring* and with said interference bead by disposition therebetween *when said flexible tab means extend generally angularly downwardly and inwardly of said annular band portion* during removal of said closure from said container for fracturing said frangible rib means.

* * * * *